US008256133B2

(12) United States Patent
Asciolla et al.

(10) Patent No.: US 8,256,133 B2
(45) Date of Patent: Sep. 4, 2012

(54) DRYER EXHAUST DUCT ALARM

(75) Inventors: Thomas J. Asciolla, Monroe Township, NJ (US); Lawrance J. Paterno, Middle Town, NJ (US)

(73) Assignee: Safety First Appliance Protection, LLC, Middletown, NJ (US)

( * ) Notice: Subject to any disclaimer, the term of this patent is extended or adjusted under 35 U.S.C. 154(b) by 0 days.

(21) Appl. No.: 12/070,577

(22) Filed: Feb. 20, 2008

(65) Prior Publication Data

US 2008/0209751 A1 Sep. 4, 2008

Related U.S. Application Data

(60) Provisional application No. 60/902,203, filed on Feb. 20, 2007, provisional application No. 60/936,365, filed on Jun. 20, 2007, provisional application No. 60/965,371, filed on Aug. 20, 2007.

(51) Int. Cl.
*F26B 19/00* (2006.01)

(52) U.S. Cl. ..... 34/140; 34/88; 34/89; 34/235

(58) Field of Classification Search ..... 34/88, 89, 34/140, 235; 454/56, 67
See application file for complete search history.

(56) References Cited

U.S. PATENT DOCUMENTS

| | | | | |
|---|---|---|---|---|
| 3,858,088 | A * | 12/1974 | Scarpino et al. | 315/200 A |
| 4,967,490 | A * | 11/1990 | Berger et al. | 34/235 |
| 5,228,092 | A * | 7/1993 | Nakamura et al. | 381/151 |
| 5,916,023 | A * | 6/1999 | Meyer | 34/235 |
| 5,922,051 | A * | 7/1999 | Sidey | 709/223 |
| 6,443,907 | B1 * | 9/2002 | Mansy et al. | 600/529 |
| 6,637,127 | B2 | 10/2003 | Reede et al. | |
| 6,785,981 | B1 | 9/2004 | Harpenau | |
| 6,914,532 | B2 * | 7/2005 | Crooks et al. | 340/606 |

* cited by examiner

*Primary Examiner* — Jiping Lu
(74) *Attorney, Agent, or Firm* — Kammer Browning PLLC

(57) ABSTRACT

A dryer exhaust duct alarm detects the presence of lint or other obstructions in an exhaust duct or vent. A thin lever is suspended within the duct and is slightly cupped in shape to more effectively capture air flow. In the presence of uninhibited air flow, the lever is substantially displaced from its initial substantially-vertical position toward a substantially horizontal position. But when airflow is inhibited, the lever is not sufficiently displaced. A detector detects operation of the dryer. If the dryer operates for a determined period of time but the lever is not sufficiently displaced, the user is alerted of the problem. Other data may also be presented to the user, including real-time data over a communication medium.

8 Claims, 7 Drawing Sheets

DRYER EXHAUST DUCT ALARM

CROSS REFERENCE TO RELATED APPLICATIONS

This application claims the benefit of U.S. provisional applications 60/902,203, filed Feb. 20, 2007, 60/936,365 filed Jun. 20, 2007, and 60/965,371 filed Aug. 20, 2007, which are incorporated herein by reference.

This application claims the benefit of U.S. provisional application 60/902,203, filed Feb. 20, 2007, which is incorporated herein by reference.

BACKGROUND

This specification relates to the field of home appliance safety and more particularly to an alarm for detecting obstructions in a dryer vent.

Dryer vents are a necessary part of a drying system. In a typical consumer- or commercial-grade dryer, clothes are dried with heated air. Dry, cool ambient air is pulled into the dryer and heated. The heated air extracts moisture from the wet clothes. The now-moist air must be exhausted from the system and replaced with dry air.

A result of this process is that lint and other flammable material is sometimes extracted from the clothes being dried. This lint can then be expelled with the exhaust air. Most dryers provide a lint trap to capture the bulk of this lint, but the lint traps are imperfect, and some lint will escape into the exhaust vent. If lint builds up, it can decrease the efficiency of the dryer and even present a fire hazard if lint ends up in the heating element.

DETAILED DESCRIPTION OF THE EMBODIMENTS

Figure 1:
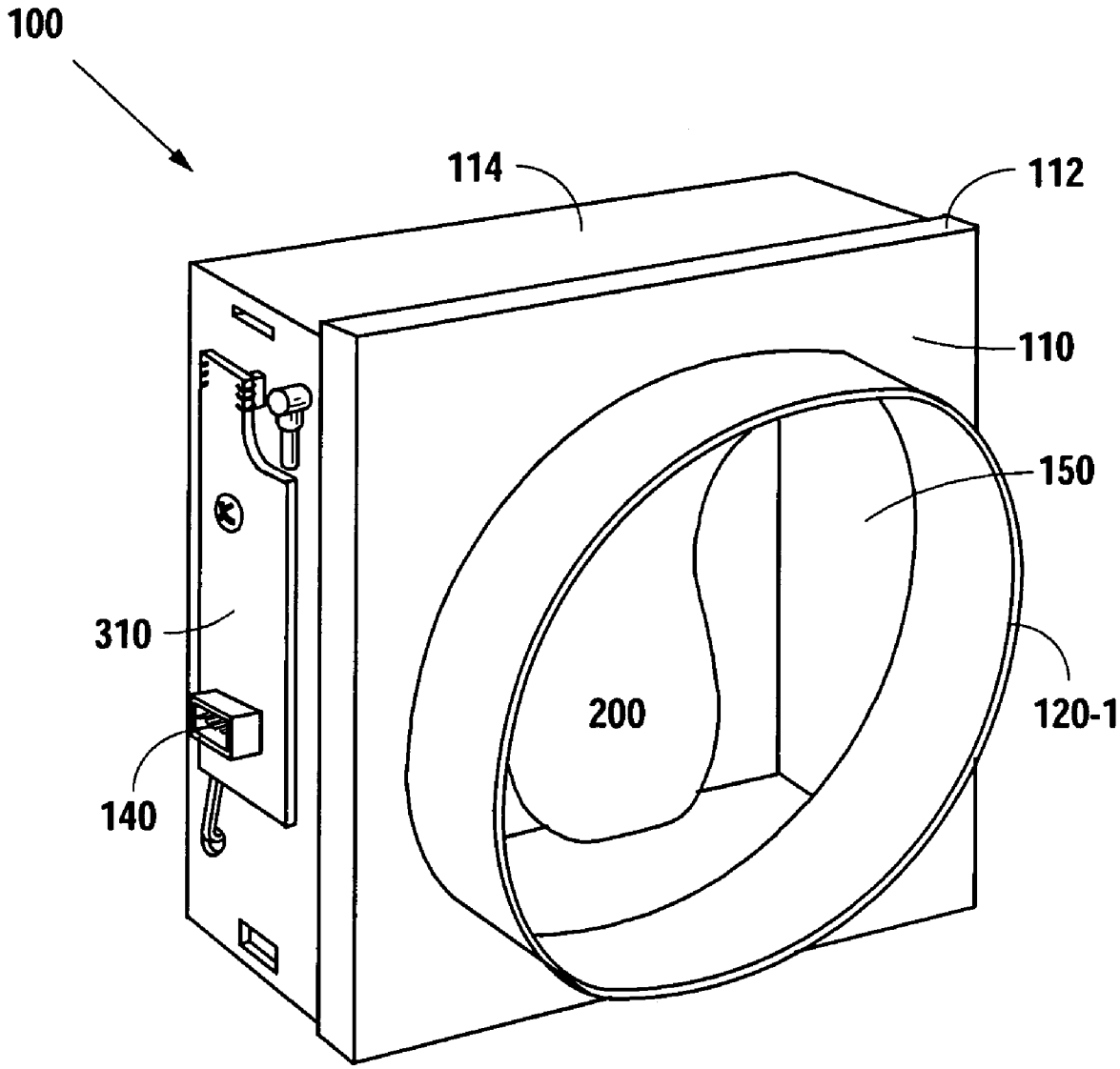
FIG. 1 is a perspective view of a dryer exhaust duct alarm.

A dryer exhaust duct alarm detects the presence of lint or other obstructions in an exhaust duct or vent. A thin lever is suspended within the duct and may be slightly cupped in shape to more effectively capture air flow. In the presence of uninhibited air flow, the lever is substantially displaced from its initial substantially-vertical position toward a substantially horizontal position. But when airflow is inhibited, the lever is not sufficiently displaced. A detector detects operation of the dryer. If the dryer operates for a determined period of time but the lever is not sufficiently displaced, the user is alerted of the problem. Other data may also be presented to the user, including real-time data over a communication medium.

A dryer exhaust duct alarm will now be described with more particular reference to the attached drawings. Hereafter, details are set forth by way of example to facilitate discussion of the disclosed subject matter. It should be apparent to a person of ordinary skill in the field, however, that the disclosed embodiments are exemplary and not exhaustive of all possible embodiments. Throughout this disclosure, a hyphenated form of a reference numeral refers to a specific instance or example of an element and the un-hyphenated form of the reference numeral refers to the element generically or collectively. Thus, for example, widget 102-1 may refer to a "pen," which may be an instance or example of the class of "writing implements." Writing implements may be referred to collectively as "writing implements 102" and any one may be referred to generically as "a writing implement 102."

Figure 5:
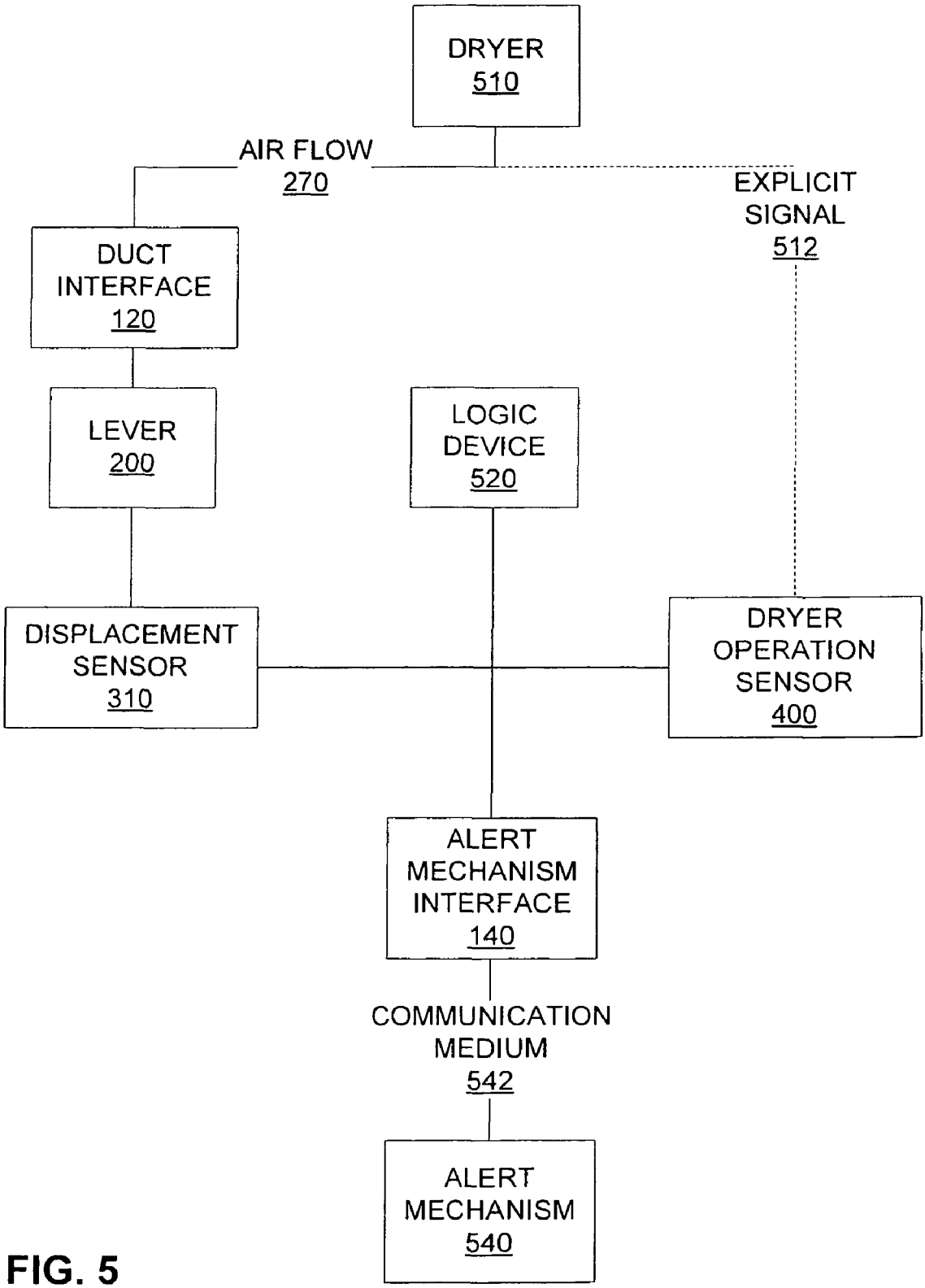
FIG. 5 is a block diagram of a dryer system equipped with an exhaust duct alarm system.

FIG. 1 is a perspective view of a dryer exhaust duct alarm 100. The alarm includes an enclosure 110, which may consist of a first layer 112 and a second layer 114 that are joined together. There are duct interfaces 120 on either side of enclosure 110. The duct interfaces are configured to interface with a standard dryer duct and to promote free air flow through conduit 150. Dryer exhaust duct alarm 100 also includes an alert mechanism interface 140, which may be contained within an electronics housing 310. Alert mechanism interface 140 is configured to provide communication with an alert mechanism 540 (FIG. 5). Suspended within conduit 150 is lever 200, which is adapted to be displaced in the presence of air flow.

Figure 2A:
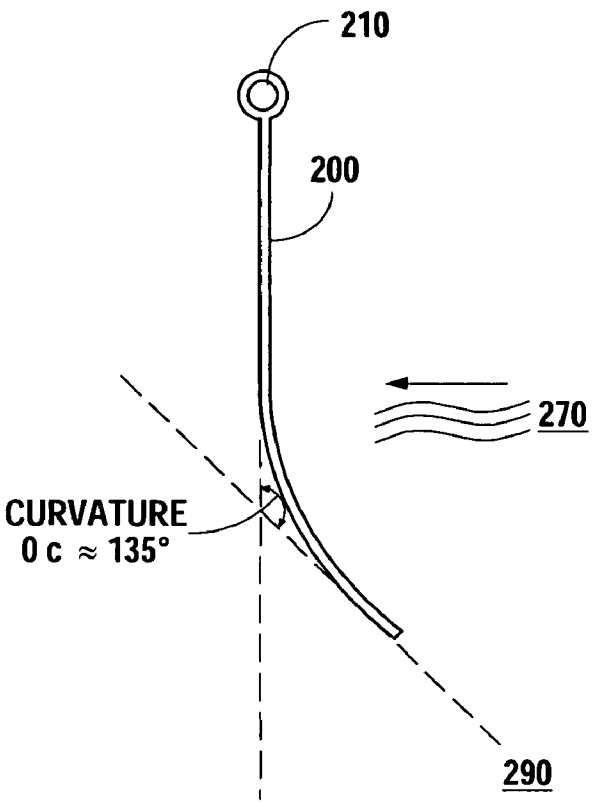
FIG. 2A is a side view of a lever showing the curvature of the cup shape.
Figure 2:
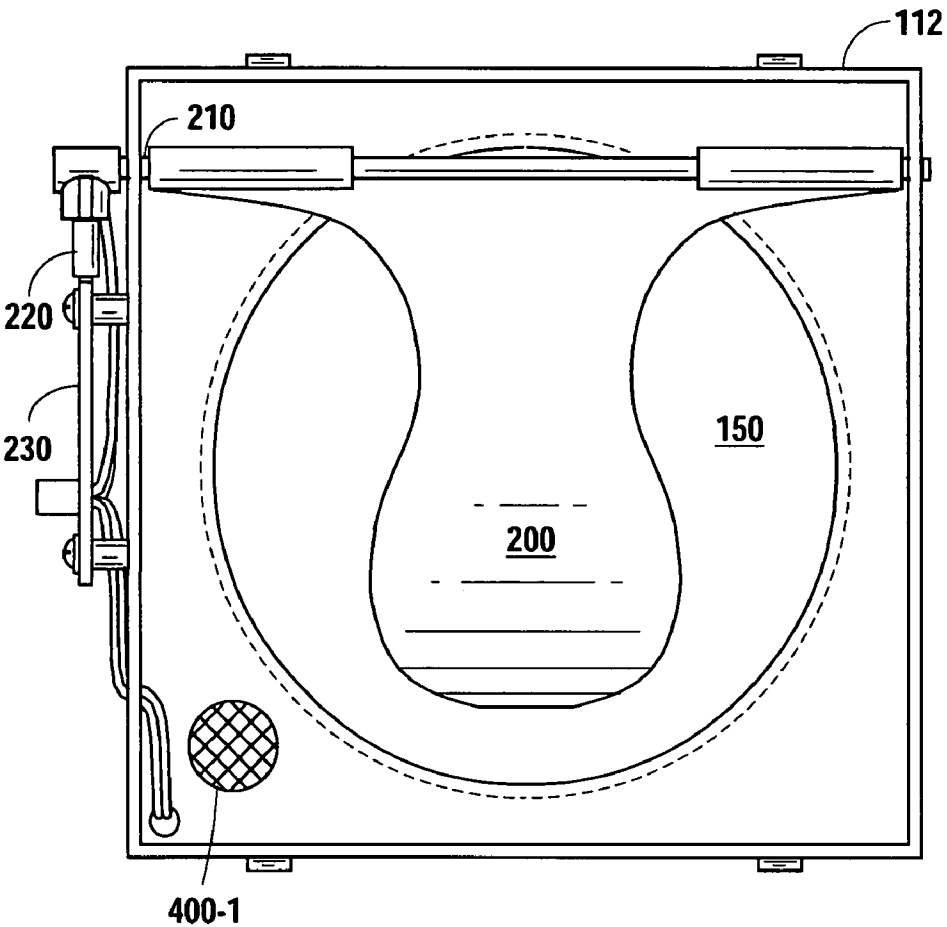
FIG. 2 is a cutaway view of a dryer exhaust duct alarm showing the lever with more particularity.

FIG. 2 discloses lever 200 with more particularity. In this cutaway view, there can be seen a portion of first layer 112. An axle 210 is provide from which lever 200 is suspended. As is seen in this view, lever 200 may be substantially bell shaped, and should be suspended so as to move freely in conduit 150. There is also attached to axle 210 a metallic bar 220, which rotates with axle 210. A mounting board 230 is seen, on which electronic components may be mounted. Mounting board 230 is housed within electronics housing 240. There is also seen in this view the placement of a microphone 400-1, which may act as a dryer operation sensor 400.

FIG. 2A shows lever 200 in a side view, suspended from axle 210. The angular curvature 290 is selected to form a substantially concave lever 200, which will effectively receive air flow 270. IN some embodiments, the angular curvature 290 may be between 120 and 150 degrees. In the specific embodiment shown in FIG. 2A, angular curvature 290 is approximately 135 degrees. A thickness of the lever 200 is between one-half millimeter and three millimeters. The preferred thickness of the lever 200 is approximately one millimeter.

Figure 2B:
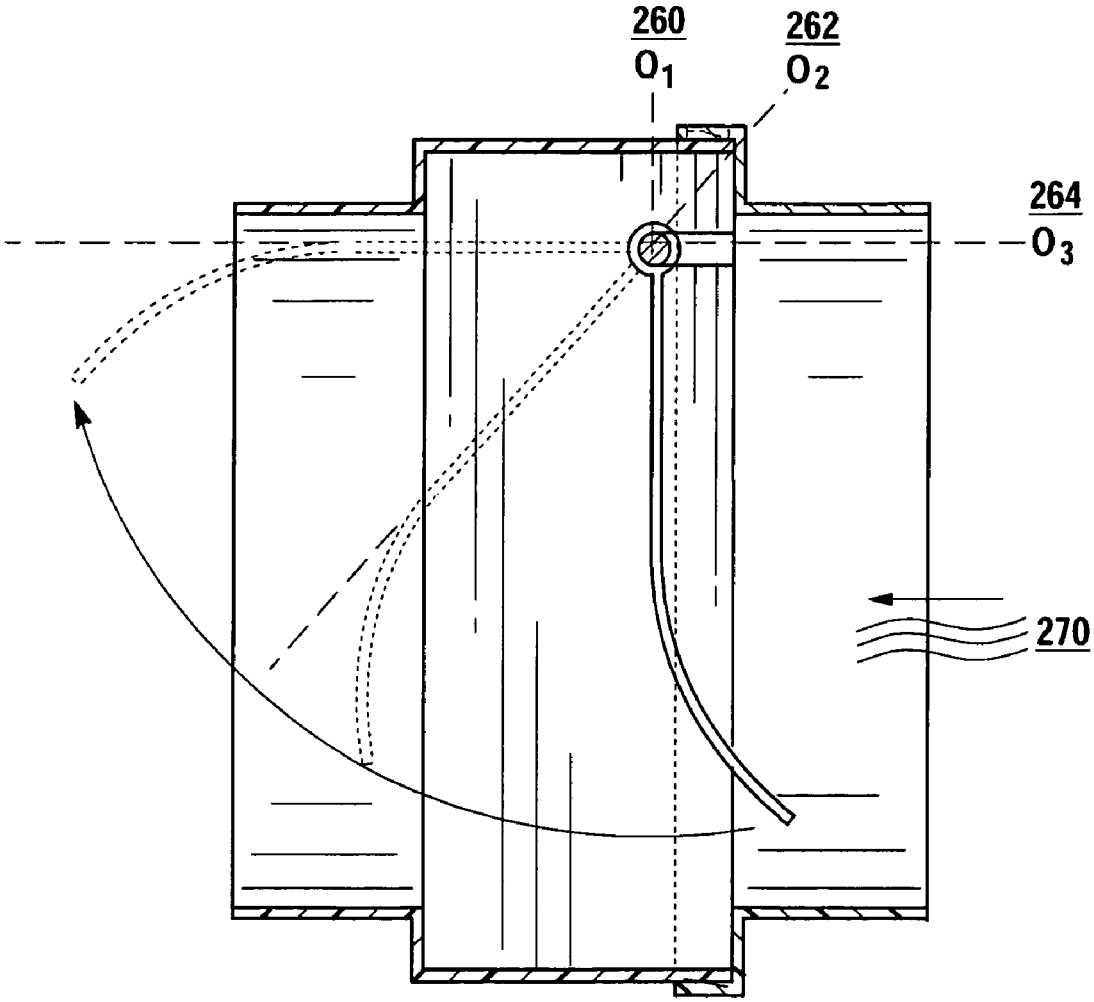
FIG. 2B is a side view of a lever in various positions in response to air flow.

FIG. 2B is a side view of lever 200 demonstrating several possible positions. When there is no air flow, lever 200 is in a rest position θ1 260. In some embodiments, θ1 260 may correspond to a substantially vertical angle. In the presence of air flow 270, lever 200 will be displaced, first passing through position θ2 262. In some embodiments, angle θ2 262 may be chosen so that lever 200 will be displaced to at least position θ2 262 in the presence of air flow 270, even if air flow 270 is partially obstructed. In these embodiments, a detector that detects the lever 200 passing through position θ2 262 may serve as dryer operation sensor 400. In those cases, position θ2 262 may be chosen depending on the weight and shape characteristics of lever 200. In some embodiments, θ2 262 may be 25 degrees from vertical.

There is also shown position θ3 264. In nominal operation, for example in the absence of an obstruction, in the presence of air flow 270, lever 200 will be displaced through position θ2 262 and up to position θ3 264. Position θ3 264 may represent a substantially or nearly horizontal position. Lever 200 resting in position θ3 264 in the presence of air flow 270 represents nominal operating conditions.

Figure 2C:
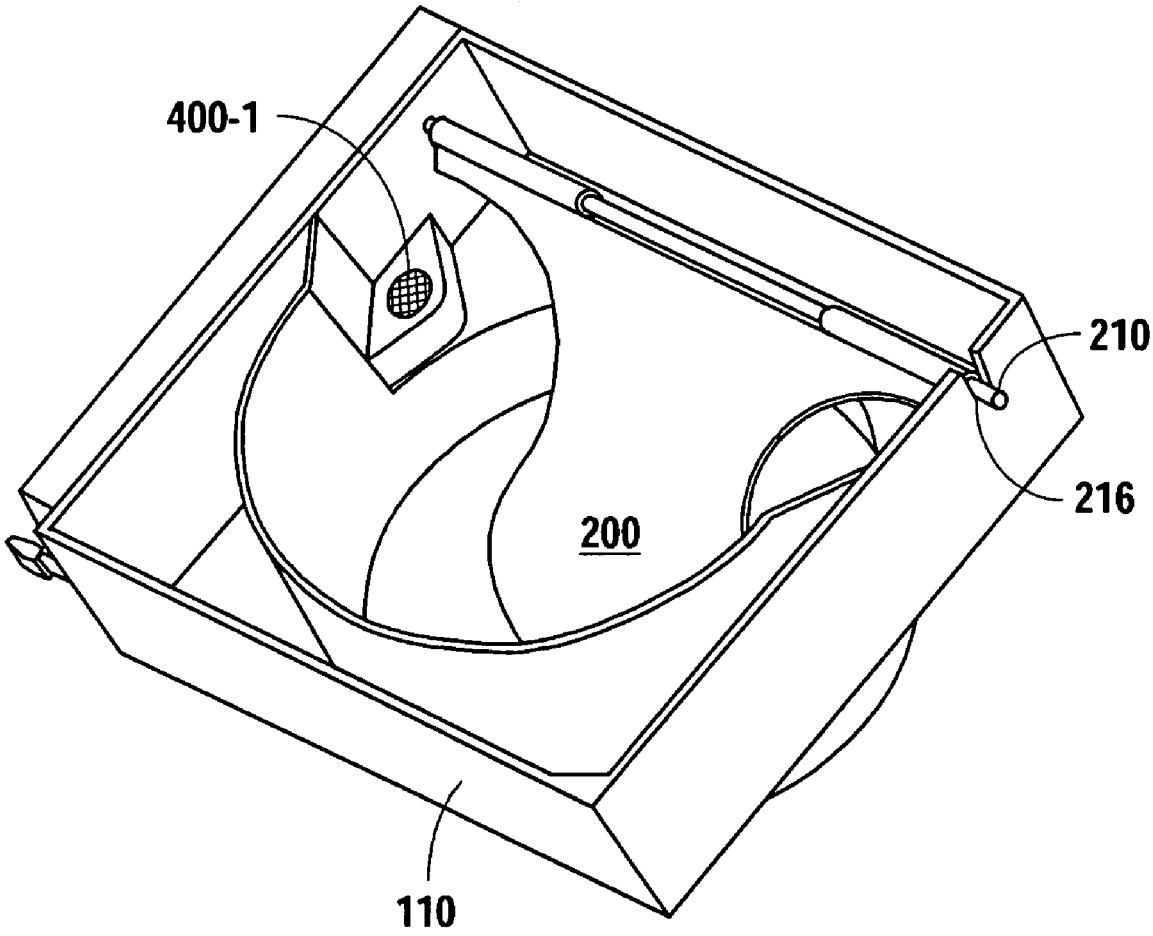
FIG. 2C is a cutaway view of a dryer exhaust duct alarm showing additional details of the lever with more particularity.

FIG. 2C discloses additional features of lever 200. In this view, it can be seen that axle 210 may be suspended through an aperture 216 in enclosure 110. This view also discloses a useful position for microphone 400-1.

Figure 3:
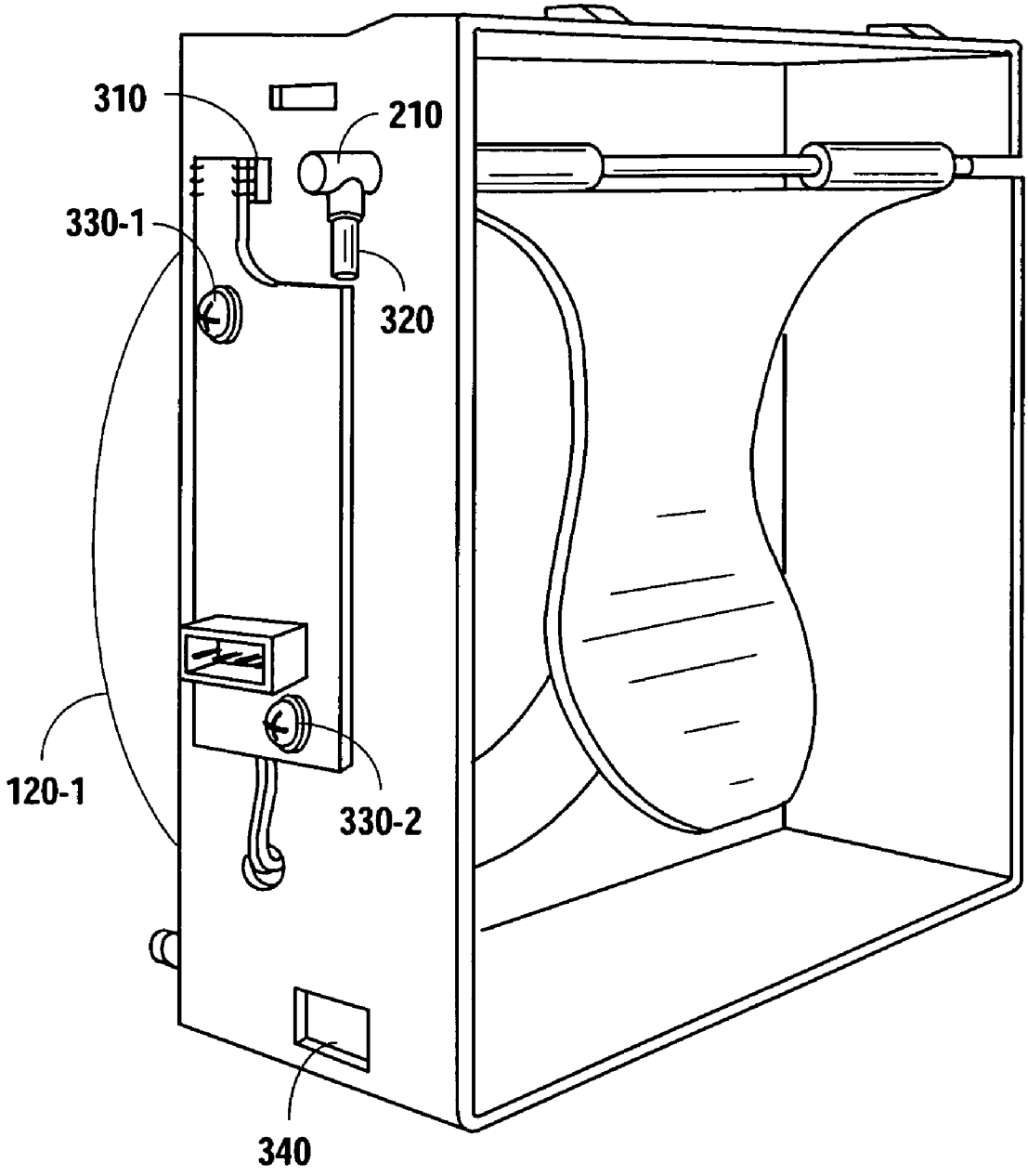
FIG. 3 is an enlarged perspective view of a dryer exhaust duct alarm showing the displacement sensor with more particularity.

FIG. 3 is an enlarged view of a dryer exhaust duct alarm 100. This view more particularly discloses certain components. In this view, it is more clear that, attached to axle 210 there is a metallic bar 320. This metallic bar is fixed with respect to axle 210, such that when axle 210 rotates, metallic bar 320 also rotates through the same angle. A displacement sensor 310 is provided, which may be any type of sensor that detects the displacement of metallic bar 320. In some embodiments, this may be a simple proximity trigger. In those cases, displacement sensor is placed so as to trigger when metallic bar 320 passes through a desired angle, such as θ3 264 (FIG. 2B) or θ2 262 (FIG. 2B).

In other embodiments, displacement sensor 310 and metallic bar 320 may be replaced with another angle-sensing mechanism. For example, a high-resolution device such as a synchro may be used.

In nominal operation, displacement sensor 310 will detect that metallic bar 320 is resting at the desired angle θ3 264 (FIG. 2B). There can also be seen in this view standoffs 330 and a clip insert, which may be used for attaching electronics housing 310.

Figure 4:
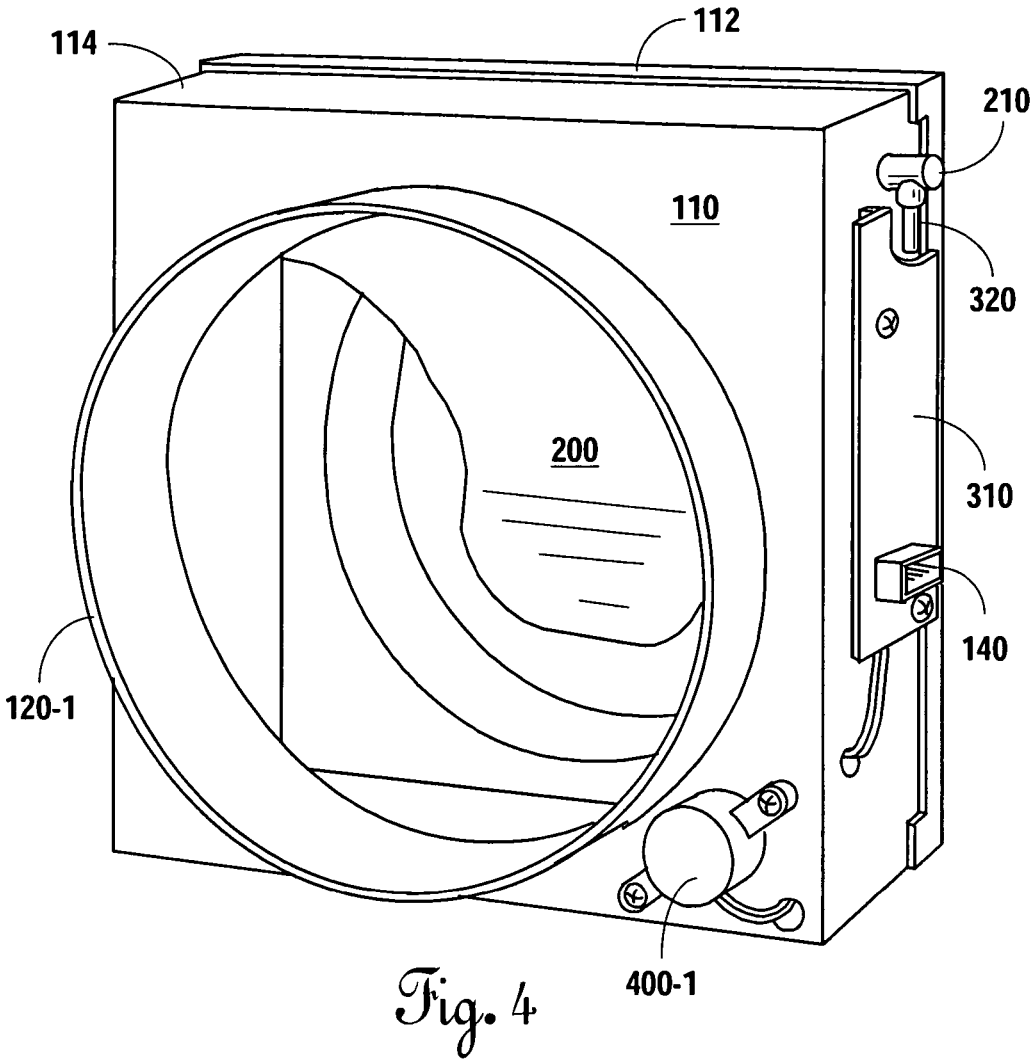
FIG. 4 is an enlarged view of a dryer exhaust duct alarm showing a microphone with more particularity.
Figure 6:
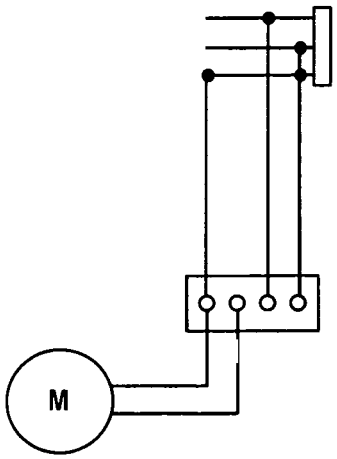

FIG. 4 is an enlarged view of a dryer exhaust duct alarm 100, showing more particularly microphone 400-1, which is an example of a dryer operation sensor 400. It is within the grasp of persons having ordinary skill in the art to select from a number of available microphone styles, including such well known examples as capacitive, electret, piezoelectric, and carbon microphones, among others. It will also be appreciated that the intended function of microphone 400-1 is to detect the operation of the dryer, and thus it can be interchanged with other types of dryer operation detectors. For example, in some embodiments, an inductive clamp may be used as a dryer operation sensor 400. In those cases, the clamp may be attached to the dryer's power supply cord, so that when current flows through the cord to the dryer, it is detected that the dryer is operating. In other embodiments, a dryer exhaust duct alarm 100 may be installed by the original equipment manufacturer (OEM) of a dryer as part of the original equipment. In those cases, dryer operation sensor 400 may be provided as an explicit signal indicating that the dryer is operating.

FIG. 5 is a block diagram showing the interconnections between components of a dryer exhaust duct alarm 100. Dryer 510 provides air flow 270 into duct interface 120. Air flow 270 strikes lever 200, displacing it through an angle. Displacement sensor 310 detects the angular displacement of lever 200. Dryer operation sensor 400 may or may not be directly coupled to dryer 510. Dryer operation sensor 400 operates to detect that the dryer is operating. Logic device 520 may be any analog or digital device capable of processing the necessary signals. Logic device 520 receives from dryer operation sensor 400 a signal indicating that dryer 510 is operating. Logic device 520 then checks the displacement of lever 200 via displacement sensor 310. If dryer 520 has been operating for a sufficient time, but the angular displacement of lever 200 is still inadequate, then logic device 520 generates an alarm condition and may provide data to alert mechanism interface 140. Alert mechanism interface 140 may connect logic device 520 to alert mechanism 540 via a communication medium 542. Communication medium 542 may be a medium such as a simple wired signal, a serial or parallel interface, an infrared interface, or a wired or unwired internet protocol interface. If alert mechanism 540 receives an alarm condition from logic device 520, it responds accordingly.

For example, in some embodiments, alert mechanism 540 may include a combination of audible and visible alarms. In other embodiments, and particularly those where dryer exhaust duct alarm is provided by the OEM, the alert mechanism may include a display that includes more detailed data, including real-time and trending data, which may be displayed graphically. In yet other embodiments, alert mechanism interface 140 may be an interface capable of connecting to an internet protocol (IP) or other similar network. In those cases, data may be provided to other network-aware devices, including computers, e-mail and hand-held wireless devices. The trending data and/or alarm condition may be conveyed graphically, or through such services as an e-mail sent to a user's e-mail account or a text message sent to a user's mobile phone.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

What is claimed is:

1. An alarm for detecting obstructions in a dryer exhaust duct and alerting a user to the obstruction, the alarm comprising:

an enclosure having a first duct interface and a second duct interface, the first and second duct interfaces configured to securely joint to the exhaust duct so that the enclosure sits inline with airflow through the exhaust duct, an expected direction of airflow being from the first interface to the second interface;

a freely rotating axle installed substantially near the top of the enclosure and oriented perpendicular to the expected direction of airflow;

a single bell-shaped lever constructed of material having a thickness between one-half and three millimeters, and affixed to the axle so that motion of the lever is translated to the axle, the lever positioned to substantially intersect the expected director of airflow, the lever affixed to the axle so that the initial position of the lever in the absence of airflow is substantially vertical; and bell-shaped lever having a curvature between 120 degrees and 150 degrees, the curvature oriented toward the expected direction of airflow;

an angular displacement sensor configured to detect angular displacement of the axle and to provide a displacement signal, the angular displacement sensor comprising a metallic bar projecting perpendicular from the axle, and a magnetic detector configured to detect proximity of the metallic bar;

a dryer operation sensor configured to detect operation of the dryer, and provide a dryer operation signal when the dryer is in an operational state, the dryer operation sensor comprising a piezoelectric or capacitive microphone positioned substantially on the lower part of the enclosure;

an audible alarm configured to operate upon receipt of an alarm signal;

a logic device communicatively coupled to the angular displacement sensor, the dryer operation sensor, and the audible alarm, the logic device configured to:

receive the dryer operation signal;

upon receiving the dryer operation signal;

receive the angular displacement signal;

compare the angular displacement signal to a threshold, the threshold being 25 degrees past vertical;

upon detecting that the angular displacement is below the threshold, provide an alarm signal to the audible alarm;

whereby an obstruction in the exhaust duct causes an airflow back current, which current engages the curvature of the lever, driving the lever to an angular position below the threshold, and the logic device is enabled to detect the obstruction.

2. The alarm of claim 1 further comprising a visible indicator configured to operate upon receipt of the alarm signal.

3. The alarm of claim 1 further comprising:

a network interface communicatively coupled to the logic device;

wherein the logic device is configured to provide data through the network interface.

4. The alarm of claim 3 wherein the data provided through the network interface are trend data.

5. The alarm of claim 4 wherein the trend data are real-time data.

6. The alarm of claim 4 further comprising a display communicatively coupled to the logic device, wherein the display is configured to display a representation of the data.

7. The alarm of claim 1 wherein a thickness of the lever is approximately one millimeter.

8. The alarm of claim 1 wherein the angle of curvature is approximately 135 degrees.

* * * * *